US011519607B2

(12) United States Patent
Cowan

(10) Patent No.: US 11,519,607 B2
(45) Date of Patent: Dec. 6, 2022

(54) CONFIGURABLE CONTROL SELECTORS WITH INTEGRATED ILLUMINATED DISPLAYS

(71) Applicant: Midea Group Co., Ltd., Foshan (CN)

(72) Inventor: Richard W. Cowan, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 176 days.

(21) Appl. No.: 16/887,542

(22) Filed: May 29, 2020

(65) Prior Publication Data

US 2021/0270465 A1 Sep. 2, 2021

Related U.S. Application Data

(63) Continuation of application No. 16/805,233, filed on Feb. 28, 2020.

(51) Int. Cl.
*F24C 3/12* (2006.01)

(52) U.S. Cl.
CPC ..... *F24C 3/122* (2013.01); *F24C 3/124* (2013.01)

(58) Field of Classification Search
CPC . F24C 3/12; H01H 9/181; G05B 2219/23132; G05B 2219/23139; H05K 2201/10136
See application file for complete search history.

(56) References Cited

U.S. PATENT DOCUMENTS

| | | | |
|---|---|---|---|
| 5,241,463 | A | 8/1993 | Lee et al. |
| 5,560,349 | A | 10/1996 | Lucero |
| 5,813,320 | A | 9/1998 | Frasnetti et al. |
| 7,926,964 | B2 | 4/2011 | Claprood |
| 8,783,243 | B2 | 7/2014 | Hodapp et al. |
| 9,156,727 | B2 | 10/2015 | Siebers et al. |
| 10,073,537 | B2 | 9/2018 | Lee et al. |
| 10,092,129 | B2 | 10/2018 | Jenkins et al. |
| 10,184,655 | B2 | 1/2019 | Knoche et al. |
| 2002/0190057 | A1 | 12/2002 | Staebler et al. |
| 2006/0016799 | A1 | 1/2006 | Klask |
| 2007/0125356 | A1 | 6/2007 | Crnkovich |
| 2007/0204858 | A1 | 9/2007 | Abelbeck |
| 2010/0200565 | A1 | 8/2010 | Leung et al. |
| 2011/0126822 | A1 | 6/2011 | Barritt et al. |
| 2016/0123600 | A1 | 5/2016 | Phillips et al. |

(Continued)

FOREIGN PATENT DOCUMENTS

| | | | |
|---|---|---|---|
| CN | 101696742 | A | 4/2010 |
| CN | 201697171 | U | 1/2011 |

(Continued)

OTHER PUBLICATIONS

Related Applications Transmittal dated Sep. 14, 2021.

(Continued)

*Primary Examiner* — Joel M Attey
*Assistant Examiner* — Bryan M Badalamenti
(74) *Attorney, Agent, or Firm* — Middleton Reutlinger

(57) ABSTRACT

A system for controlling an appliance having a plurality of gas cooktop burners operated by a plurality of digital gas valves includes a plurality of control selectors that include illuminated displays on faces thereof for indicating to which gas cooktop burner each control selector is assigned.

18 Claims, 6 Drawing Sheets

(56) References Cited

U.S. PATENT DOCUMENTS

| | | | |
|---|---|---|---|
| 2016/0313002 | A1 | 10/2016 | Johncock et al. |
| 2017/0276374 | A1 | 9/2017 | Cadima |
| 2017/0292712 | A1 | 10/2017 | Alexander |
| 2018/0142446 | A1 | 5/2018 | Silber et al. |
| 2018/0209660 | A1 | 7/2018 | Stokes et al. |
| 2018/0359819 | A1 | 12/2018 | Cadima |
| 2019/0056116 | A1 | 2/2019 | Cadima |
| 2019/0093899 | A1 | 3/2019 | Mugica Odriozola et al. |
| 2019/0195507 | A1 | 6/2019 | Fumagalli et al. |
| 2020/0245574 | A1 | 8/2020 | Woytowitz et al. |
| 2020/0392700 | A1 | 12/2020 | Burnier |
| 2021/0270464 | A1 | 9/2021 | Cowan |
| 2021/0271284 | A1 | 9/2021 | Cowan |

FOREIGN PATENT DOCUMENTS

| | | | | |
|---|---|---|---|---|
| CN | 202927899 | U | 5/2013 | |
| CN | 104976645 | A | 10/2015 | |
| DE | 102019123393 | A1 * | 3/2021 | |
| EP | 1094276 | A1 | 4/2001 | |
| EP | 3333866 | A1 * | 6/2018 | ..... G06F 3/0362 |
| WO | WO-2013175439 | A1 * | 11/2013 | ..... F23N 5/203 |
| WO | WO-2015104482 | A1 * | 7/2015 | ..... B60K 37/06 |

OTHER PUBLICATIONS

International Search Report and Written Opinion issued in Application No. PCT/CN2020/097874, dated Dec. 4, 2020.

Chia-Hsun Lee et al., The Kitchen as a Graphical User Interface, MIT Media Laboratory, 2003.

Leonardo Bonanni et al., CounterIntelligence: Augmented Reality Kitchen, MIT Media Laboratory, Apr. 2-7, 2005.

Chukwuedozie N. Ezema et al., Design and Implementation of a Microcontroller-Based Digital Time Aware Oven Temperature Controller and Display. International Journal of Multidisciplinary Research and Modern Education, ISSN 2454-6119, www.rdmodernresearch.com, vol. II, Issue I, 2016.

U.S. Patent and Trademark Office, Office Action issued in U.S. Appl. No. 16/805,233 dated May 2, 2022.

U.S. Patent and Trademark Office, Office Action issued in U.S. Appl. No. 16/805,265 dated Mar. 21, 2022.

Savani, Avinash A., United States Patent and Trademark Office; Notice of Allowance issued in U.S. Appl. No. 16/805,265, 19 pages, dated Aug. 5, 2022.

Jones, Logan P., United States Patent and Trademark Office, Final Office Action issued in U.S. Appl. No. 16/805,233, 55 pages, dated Sep. 19, 2022.

* cited by examiner

CONFIGURABLE CONTROL SELECTORS WITH INTEGRATED ILLUMINATED DISPLAYS

BACKGROUND OF THE INVENTION

In appliance manufacturing generally, and specifically in manufacturing industries for ranges or cooking appliances, devices such as cooktops or ranges have a variety of control or selector knobs for adjusting and controlling the amount of heat supplied to the various appliance burners or heating elements. Typically, an individual knob is assigned to an individual burner. However, "digital" gas appliance systems are becoming more common in the art. A digital gas system for a gas range or cooktop may in many instances employ electromechanical valves that aren't necessarily even mounted proximate the knobs that operate these valves. Instead, the control knobs are mechanically coupled to a resolver or potentiometer that then supplies an electrical signal to the gas valves to open and close them, thereby controlling the burner or oven temperatures.

In many gas cooking appliances each burner or heating element is operated by a gas valve that is operatively coupled to a dedicated control knob to control the heat being applied to that burner element. This system of operation generally requires at least one control knob or selector to operate each of the various burners on the appliance. In the case of digital valves the knobs or selectors can be positioned anywhere on the appliance, since they need not be mounted proximate the valves they are controlling. Accordingly, since control knobs can be placed anywhere and need not be physically connected to the valves they are controlling it is apparent that the control knobs or selectors can be positioned or mounted in a variety of orientations or configurations.

From the foregoing background, it follows that there is no need to have a specific control valve or selector dedicated to a specific burner for each digital valve in an appliance. An appliance system having control knobs or selectors that are assignable to individual burners and valves is therefore possible.

SUMMARY OF THE INVENTION

The present disclosure is related to systems and cooking appliances that include a plurality of gas cooktop burners operated by a plurality of digital gas valves, and including a plurality of control selectors that may include illuminated displays on faces thereof for indicating to which gas cooktop burner each control selector is assigned. Further, in some instances such systems may utilize customized or configurable control selectors mounted on or even proximate the appliance that may be selectively assigned to different burners or heating elements of the appliance. In some aspects and embodiments for example the systems described herein may include a knob or selector assembly that includes a burner status display that depicts in graphical terms the status of the burner that is currently selected.

The system in accordance with some aspects may be configured by a user utilizing an operator interface to define or select a burner or a group of burners to be operated by the single control selector. Additionally, each individual control knob or selector may be rapidly switched from control of one burner to another, thereby providing safe operation of the appliance controls and providing a system for safely operating the gas valves thereof with a minimum of operator input. Furthermore, in some embodiments the assignment of a control selector to a particular burner may be represented on an illuminated display disposed on a face of the control selector itself.

In further embodiments the system described herein provides a plurality of control selectors that may be de-selected or de-coupled from the burners on the appliance to effectively disable the appliance when desired for safety considerations. Furthermore, the plurality of control selectors provided on the appliance are electrically coupled to a processor or controller to provide a desired valve position for a burner so that no selector is directly coupled to any specific valve or burner.

In various embodiments, the system disclosed herein provides a configurable knob control that, when assigned to a burner, provides a user defined operation to operate an appliance gas valve to a selected open position. In other aspects and embodiments a knob or selector mounted in a convenient location on an appliance may be configurable via a user interface to operate a plurality of valves or concomitant burners, or alternatively a remotely or locally located selector button or switch may be provided for assigning the selector or control knob to actuate a valve.

In various aspects and embodiments the system described herein may include a processor having a plurality of inputs and outputs that are operatively coupled to various components of an appliance, including a user interface and a plurality of control selectors having a rotatable portion that is operatively coupled to a resolver or equivalent signal generator. In some embodiments processor or controller may be coupled with a user interface that is suitably programmed to provide a configurable control selector that may be initiated by a user to configure the burner assignment process.

In some embodiments, a cooking appliance may include a plurality of gas cooktop burners having associated digital gas valves that selectively couple the plurality of gas cooktop burners to a gas supply, a plurality of control selectors configured to control output levels of the plurality of gas cooktop burners, each control selector including an associated illuminated display disposed on a face thereof, and a controller configured to control the plurality of digital gas valves in response to user input directed to the plurality of control selectors, where the controller is further configured to control the associated illuminated displays of the plurality of control selectors to display, for each control selector among the plurality of control selectors, which gas cooktop burner among the plurality of gas cooktop burners is controlled by such control selector.

In some embodiments, the illuminated display of each of the plurality of control selectors includes a plurality of lights arranged in a pattern representative of an arrangement of the gas cooktop burners on a cooktop, and the controller is configured to control the associated illuminated displays of the plurality of control selectors by illuminating, for each control selector among the plurality of control selectors, a light among the plurality of lights in the associated illuminated display that corresponds to the gas cooktop burner among the plurality of gas cooktop burners that is controlled by such control selector. Also, in some embodiments, the illuminated display of each of the plurality of control selectors includes a display screen, and the controller is configured to control the associated illuminated displays of the plurality of control selectors by displaying, for each control selector among the plurality of control selectors, a graphical indication that corresponds to the gas cooktop burner among the plurality of gas cooktop burners that is controlled by such control selector on the display screen of such control selector. Further, in some embodiments, each graphical indication includes a plurality of burner icons arranged in a pattern representative of an arrangement of the gas cooktop burners on a cooktop.

In some embodiments, each control selector includes a rotatable knob. In addition, in some embodiments, the associated illuminated display of each control selector is disposed on a front face of the rotatable knob and rotates with the rotatable knob. In some embodiments, each control selector includes a rotatable ring. In addition, in some embodiments, the associated illuminated display of each control selector is disposed on a stationary front face of the control selector.

Moreover, in some embodiments, each control selector further includes a button disposed on a front face of such control selector to shut off the associated digital gas valve of the gas cooktop burner controlled by such control selector. In some embodiments, the controller is configured to controllably reassign one or more of the plurality of control selectors to different gas cooktop burners among the plurality of gas cooktop burners and to update the associated illuminated displays of the plurality of control selectors to display, for each control selector among the plurality of control selectors, which gas cooktop burner among the plurality of gas cooktop burners is controlled by such control selector after controllably reassigning the one or more of the plurality of control selectors.

In additional embodiments, a control selector system for an appliance having a plurality of gas cooktop burners operated by a plurality of digital gas valves may include a plurality of control selectors configured to control output levels of the plurality of gas cooktop burners, where a first control selector among the plurality of control selectors includes an associated illuminated display disposed on a face thereof, and a controller configured to control the plurality of digital gas valves in response to user input directed to the plurality of control selectors, where the controller is further configured to control the associated illuminated display of the first control selector to display which gas cooktop burner among the plurality of gas cooktop burners is controlled by the first control selector.

Moreover, in some embodiments, the illuminated display of the first control selector includes a plurality of lights arranged in a pattern representative of an arrangement of the gas cooktop burners on a cooktop, and the controller is configured to control the associated illuminated display of the first control selector by illuminating a light among the plurality of lights in the associated illuminated display that corresponds to the gas cooktop burner among the plurality of gas cooktop burners that is controlled by the first control selector. In some embodiments, the illuminated display of the first control selector includes a display screen, and the controller is configured to control the associated illuminated display of the first control selector by displaying a graphical indication that corresponds to the gas cooktop burner among the plurality of gas cooktop burners that is controlled by the first control selector on the display screen of the first control selector. In addition, in some embodiments, the graphical indication includes a plurality of burner icons arranged in a pattern representative of an arrangement of the gas cooktop burners on a cooktop.

In some embodiments, the first control selector includes a rotatable knob. Moreover, in some embodiments, the associated illuminated display of the first control selector is disposed on a front face of the rotatable knob and rotates with the rotatable knob. Also, in some embodiments, the first control selector includes a rotatable ring. In some embodiments, the associated illuminated display of the first control selector is disposed on a stationary front face of the first control selector.

In addition, in some embodiments, the first control selector further includes a button disposed on a front face of the first control selector to shut off the associated digital gas valve of the gas cooktop burner controlled by the first control selector. Also, in some embodiments, the controller is configured to controllably reassign the first control selector to a different gas cooktop burner among the plurality of gas cooktop burners and to update the associated illuminated display of the first control selector to display which gas cooktop burner among the plurality of gas cooktop burners is controlled by the first control selector after controllably reassigning the first control selector.

As used herein for purposes of the present disclosure, the term "appliance" should be understood to be generally synonymous with and include any device that consumes electrical power and can be connected to an electrical circuit or battery, for example one used in a residential or commercial setting to accomplish work. The appliances referred to herein may include a plurality of electrically operated components powered by the circuit, the components operable by manipulation of control knobs or selectors. The appliances referred to herein may also include a gas supply or source and one or more gas valves for supplying gas to a burner or heating element. The appliance gas valves may be controlled by a selector or knob, either directly or indirectly, and the appliance may also include a processor or processors that operate, control and monitor the appliance and the various components and functions thereof referred to throughout this specification.

The terms "knob" or "selector" are used herein generally to describe various devices that are operatively coupled to functional components of the appliance and which may typically, but not exclusively, be operated by hand by a user. Typical control knobs and selectors include but are not limited to gas and electric burner controls, gas and electric oven controls, lighting and timing controls, start and stop controls, switches, sliders, pushbuttons, wheels, levers, and various other functional controls associated with an appliance. "Selector" may also be used to refer to a programmed button selection on a touch-screen or similar operator interface.

The term "controller" or "processor" is used herein generally to describe various apparatus relating to the operation of the system and the appliances referred to herein. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), programmable logic controllers (PLCs), and field-programmable gate arrays (FPGAs).

A processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present disclosure discussed herein. The terms "program" or "computer program" are used herein in a generic sense to refer to any type of computer code (e.g., software or microcode) that can be employed to program one or more processors or controllers.

The term "Internet" or synonymously "Internet of things" refers to the global computer network providing a variety of information and communication facilities, consisting of interconnected networks using standardized communication protocols. The appliances, controllers and processors referred to herein may be operatively connected to the Internet.

It should be appreciated that all combinations of the foregoing concepts and additional concepts discussed in greater detail below (provided such concepts are not mutually inconsistent) are part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. The drawings are not necessarily to scale. Emphasis is instead generally placed upon illustrating the principles of the disclosure, wherein.

DETAILED DESCRIPTION OF THE INVENTION

Figure 1:
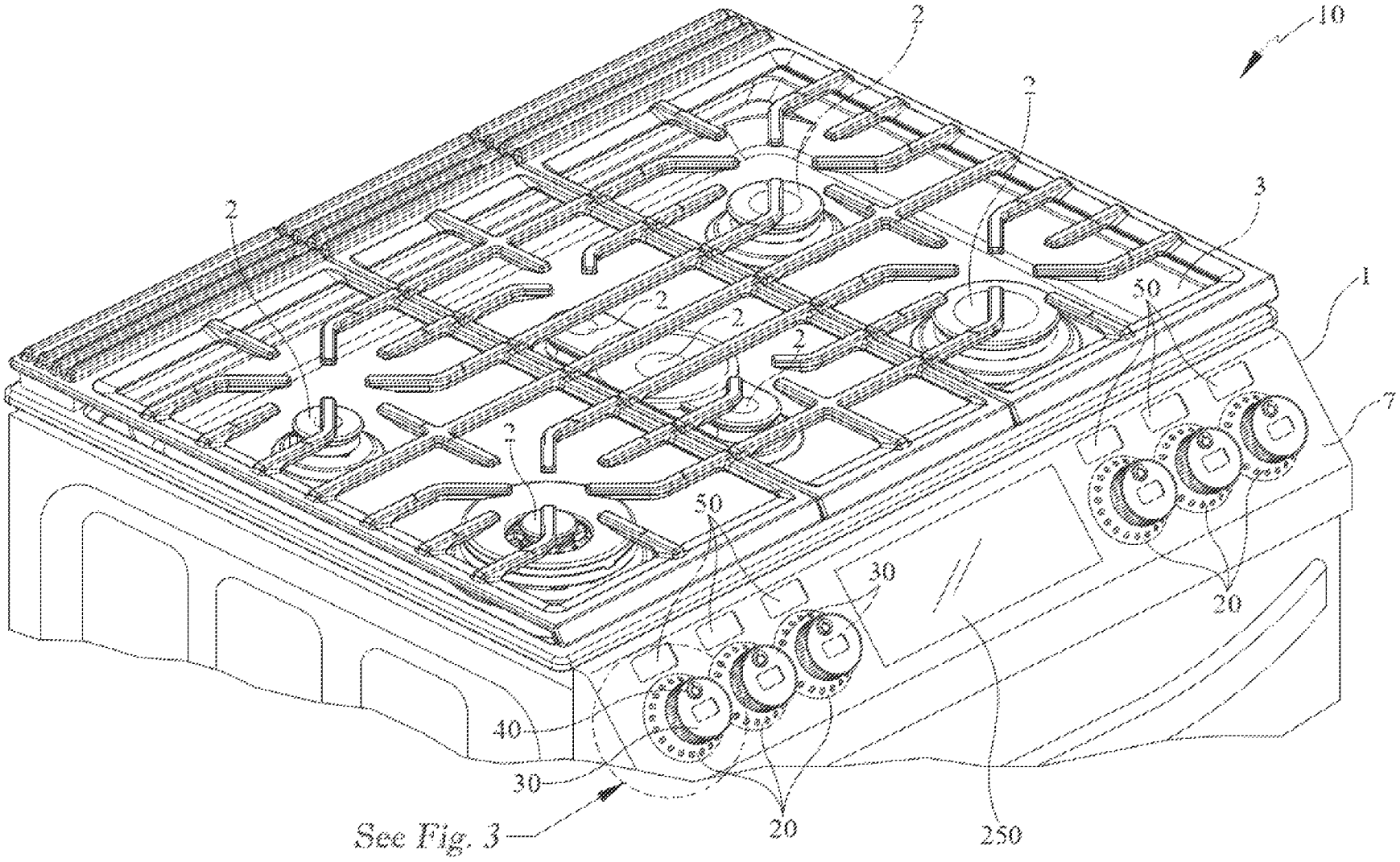
FIG. 1 is a perspective view of a gas appliance having a plurality of burners in accordance with various embodiments.

Referring to drawing FIGS. 1-5, and in accordance with various aspects and embodiments of the invention, a system 10 for an appliance 1 having a plurality of burners 2, each having a digital gas control valve 4 for supplying gas thereto is described. In one non-limiting exemplary embodiment for purposes of illustration in this specification, appliance 1 may be a gas stove 1 (or equivalently a cooktop and oven combination). Stove 1 may include a plurality of control knobs or selectors 20 to adjust the flow of gas to a plurality of gas valves 4, and thus the heat output (or output level) of a plurality of cooktop burners 2, as well as a plurality of oven heating elements or burners (not shown).

Figure 5:
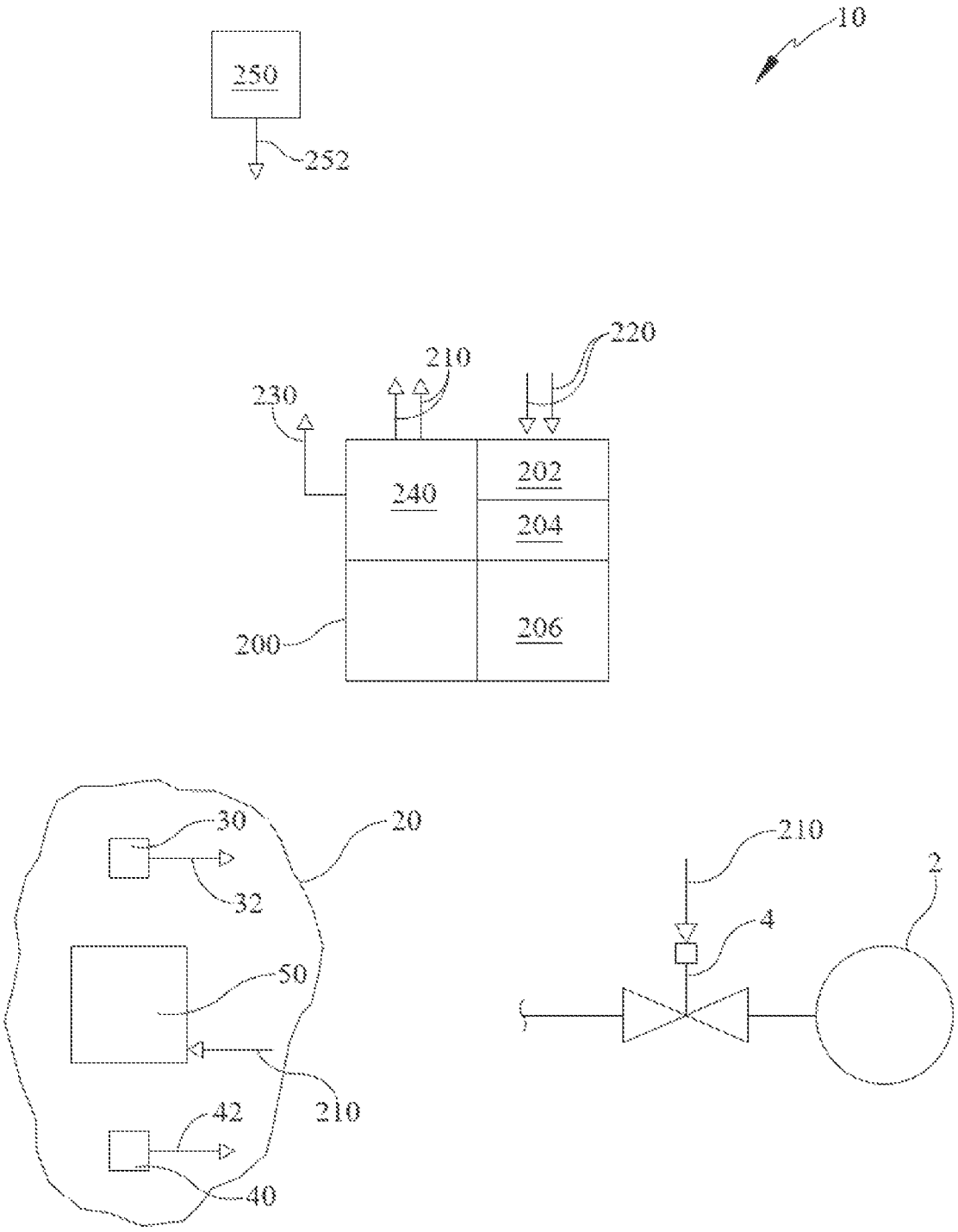
FIG. 5 is a block diagram of a control system in accordance with various embodiments.

In various embodiments the appliance 1 in which system 10 is implemented may include a controller 200 integral to appliance 1 that operates appliance 1 and implements various embodiments and aspects of system 10 as described herein. FIG. 5 illustrates an exemplary appliance 1 hardware environment for implementing system 10 for configurable control selector 20 operation. The system 10 may include a controller 200, a processor or processors 202 and concomitant memory 204. Appliance 1 controller 200 may further comprise a plurality of signal outputs 210 and signal inputs 220 that may be operatively connected to a plurality of appliance 1 components to monitor and direct system 10 operation. Furthermore, in some embodiments controller 200 may include a wireless or hard-wired communications interface 230 that enables controller 200 to communicate with external devices or communications networks such as the internet, that may be integrated into system 10.

Figure 2:
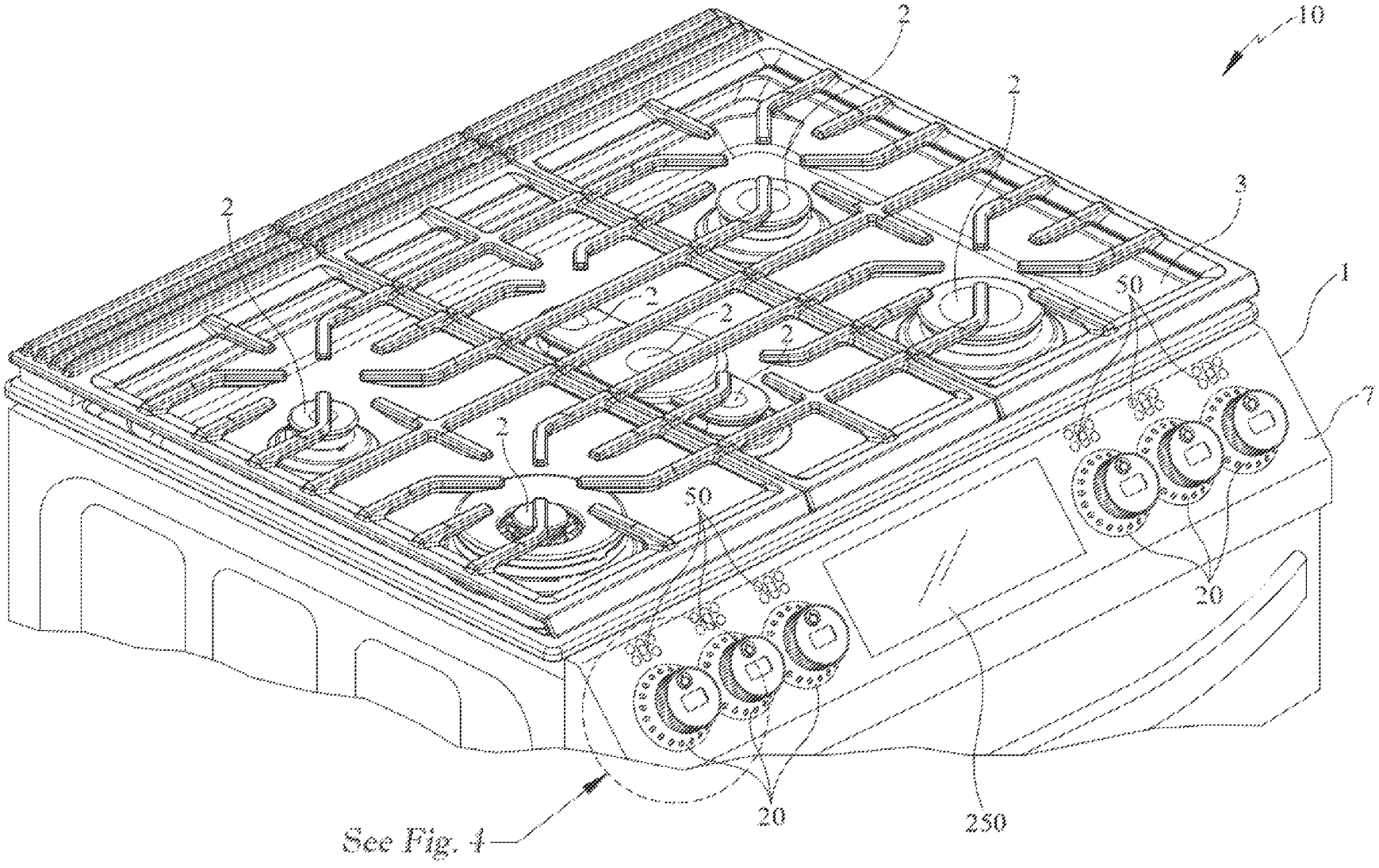
FIG. 2 is a perspective view of a gas appliance having a plurality of burners in accordance with various embodiments.

Additionally, controller 200 may be equipped with an operator or user interface 250 to provide audible or visual feedback to a user as well as provide a user the ability to provide instructions or commands to controller 200. Exemplary but non-limiting user interfaces 250 that may be employed include a mouse, keypads, touch-screens, keyboards, switches and/or touch pads. While FIGS. 1 and 2 depict an exemplary user interface 250 as a touch screen or display mounted on a front portion of appliance 1, any user interface 250 may be employed for use in the invention without departing from the scope thereof. It will be understood that FIG. 5 constitutes, in some respects, an abstraction and that the actual organization of the components of appliance 1 and controller 200 may be more complex than illustrated. Indeed, in some embodiments, any or all of controls 20 and displays 50, 60 may be considered to be incorporated into the user interface of the appliance, and in some embodiments, e.g., where user interface 250 incorporates a touch-screen or other computer-type interface, any or all of controls 20 and displays 50, 60 may be implemented within such a computer-type interface, e.g., using "soft" buttons and similar user interface controls that may be activated through interaction with the computer-type interface.

The processor 202 may be any hardware device capable of executing instructions stored in memory 204 or data storage 206 or otherwise processing data. As such, the processor may include a microprocessor, field programmable gate array (FPGA), application-specific integrated circuit (ASIC), or other similar devices.

The memory 204 may include various memories such as, for example L1, L2, or L3 cache or system memory. As such, the memory 204 may include static random access memory (SRAM), dynamic RAM (DRAM), flash memory, read only memory (ROM), or other similar memory devices. It will be apparent that, in embodiments where the processor includes one or more ASICs (or other processing devices) that implement one or more of the functions described herein in hardware, the software described as corresponding to such functionality in other embodiments may be omitted.

The user interface 250 may include one or more devices for enabling communication with a user such as an administrator. For example, the user interface 250 may include a display, a mouse, and a keyboard for receiving user commands. In some embodiments, the user interface 250 may include a command line interface or graphical user interface that may be presented to a remote terminal via the communication interface 230. Furthermore, user interface 250 may be implemented as a remote device such as a suitably programmed smart phone or tablet that communicates with controller 200 via communication interface 230.

The communication interface 230 may include one or more devices for enabling communication with other hardware devices. For example, the communication interface 230 may include a network interface card (NIC) configured to communicate according to the Ethernet protocol. Additionally, the communication interface 230 may implement a TCP/IP stack for communication according to the TCP/IP protocols. Various alternative or additional hardware or configurations for the communication interface 230 will be apparent.

The storage 206 may include one or more machine-readable storage media such as read-only memory (ROM), random-access memory (RAM), magnetic disk storage media, optical storage media, flash-memory devices, or similar storage media. In various embodiments, the storage 206 may store instructions for execution by the processor 202 or data upon with the processor 202 may operate. For example, the storage 206 may store a base operating system for controlling various basic operations of the hardware. Other instruction sets may also be stored in storage 206 for executing various functions of system 10, in accordance with the embodiments detailed below.

It will be apparent that various information described as stored in the storage 206 may be additionally or alternatively stored in the memory 204. In this respect, the memory 204 may also be considered to constitute a "storage device" and the storage 206 may be considered a "memory." Various other arrangements will be apparent. Further, the memory 204 and storage 206 may both be considered to be "non-transitory machine-readable media." As used herein, the term "non-transitory" will be understood to exclude transitory signals but to include all forms of storage, including both volatile and non-volatile memories.

While the controller 200 is shown as including one of each described component, the various components may be duplicated in various embodiments. For example, the processor 202 may include multiple microprocessors that are configured to independently execute the methods described herein or are configured to perform steps or subroutines of the methods described herein such that the multiple processors cooperate to achieve the functionality described herein.

Referring again to FIGS. 1-4, and in accordance with some exemplary embodiments, a system 10 for implementing assignable control selectors 20 for an appliance 1 having a plurality of digital gas valves 4 and concomitant burners 2 includes a plurality of control selectors 20 that are utilized to operate the plurality of digital gas valves 4 of appliance 1. It should be understood that any appliance 1 or other device that utilizes control selectors 20 wherein it would be desirable to assign specified control selectors 20 to specified burners 2 or other electrically actuated devices may form a part of the operating environment of system 10 without departing from the scope of the invention.

In some aspects and embodiments control selectors 20 include rotatable control knobs or other controls 30 that are typically turned or rotated clockwise to supply additional gas (and therefore heat) to a selected burner 2 through a digital gas valve 4, and conversely turned counter-clockwise to reduce the amount of gas (and therefore heat) to a selected burner 2. In some aspects and embodiments control knobs 30 may be rotated in a first direction to increase the open position of valve 4 and rotated in the opposite direction to reduce the open position of valve 4. It will also be appreciated that additional controls and/or knobs may be utilized in appliance 1, e.g., to control additional burners or components (e.g., an oven), so the invention is not limited to the use of the specific control selectors disclosed herein.

In some aspects of the invention control selectors 20 may include a rotatable ring or knob portion 30 that is mounted to or secured to an encoder, potentiometer, or equivalent signal generator that provides an output signal 32 that is representative of a desired gas valve 4 position and/or burner 2 heat level and is operatively coupled to an input 220 of controller 200 when control knob 30 is rotated. Controller 200 then provides a corresponding output 210 to control a specified gas valve 4 that is representative of a desired burner 2 heat level.

FIG. 1 depicts an exemplary but non-limiting system 10 having controls on a cooktop 3 which includes burners 2. Appliance 1 may include a front panel or other mounting surface 7 on which various controls of appliance 1 are mounted. In some aspects and embodiments each control selector 20 may include a rotatable selector knob or ring 30, an "on/off" button 40, and a display 50 provided on or proximate control selector 20. It should be understood that the term "burner" 2 may include an oven temperature control. It should be further understood that each burner 2 is operatively coupled to a digital gas valve 4 that is in turn operatively coupled to an input 220 and/or output 210 of controller 200, thereby providing for control of valve 4 and burner 2.

Figure 3:
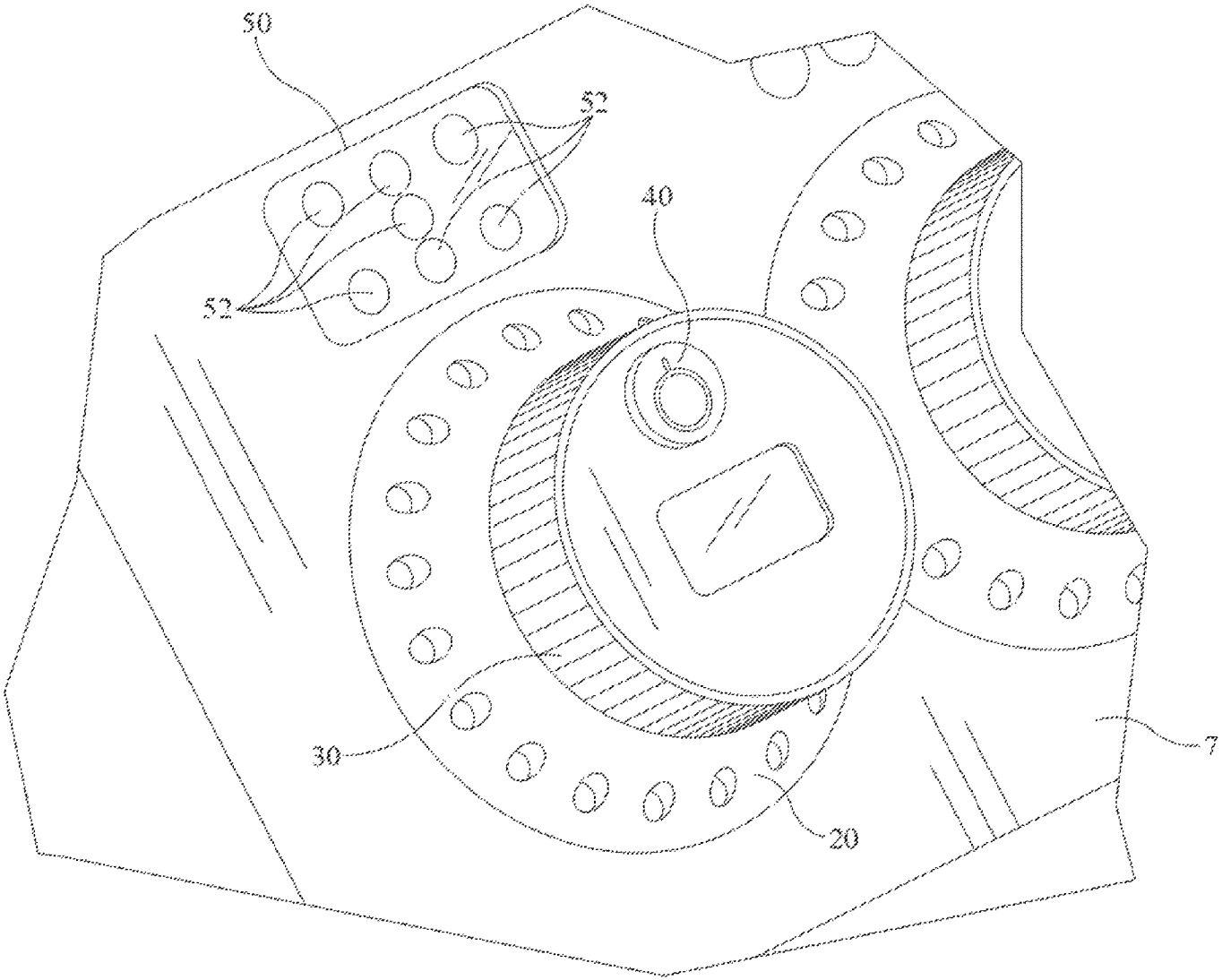
FIG. 3 is a detail view of the circle 3 of FIG. 1 in accordance with various embodiments.
Figure 4:
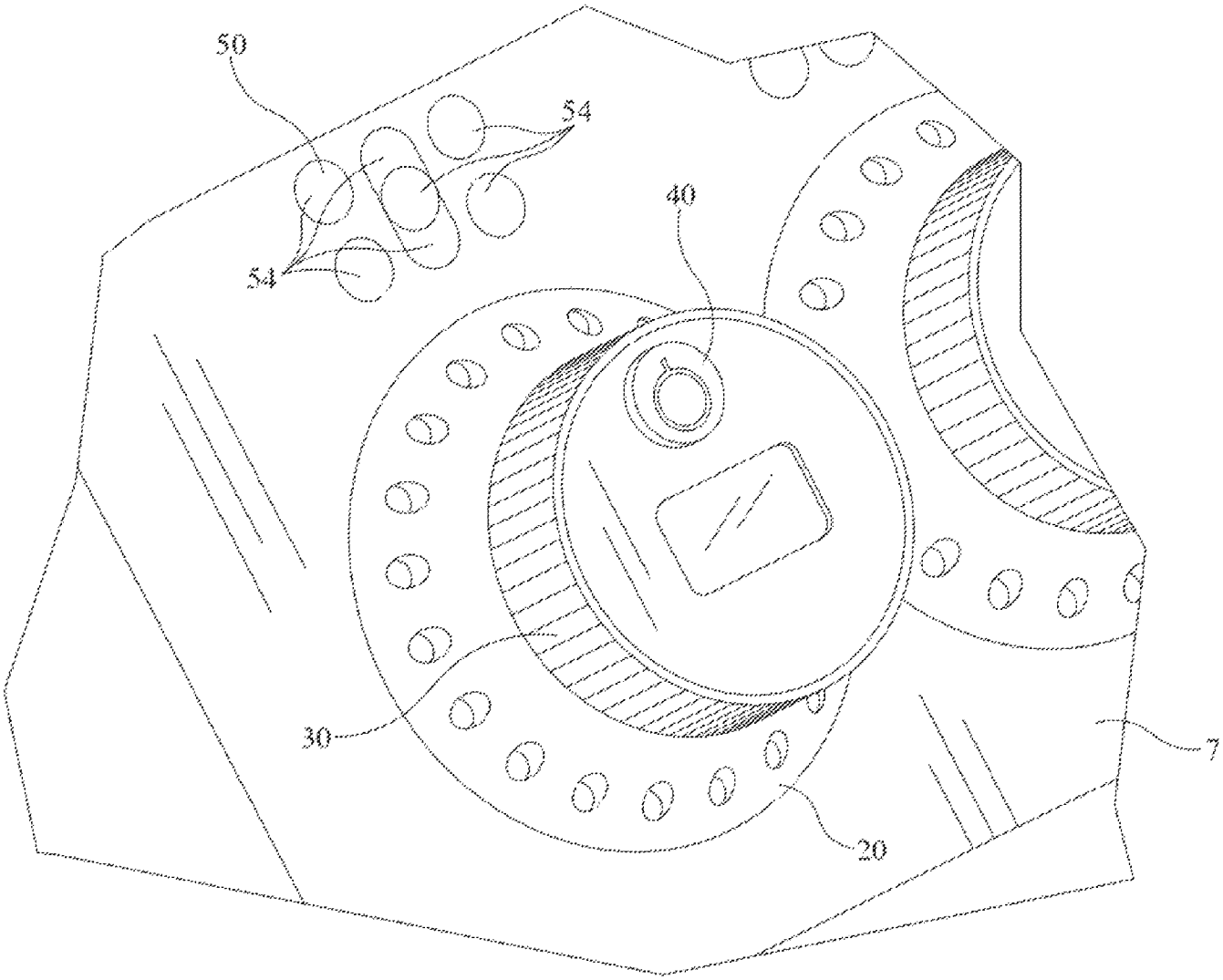
FIG. 4 is a detail view of the circle 4 of FIG. 2 in accordance with various embodiments.

In accordance with some aspects and embodiments and as best seen in detail in FIGS. 3 and 4, each control selector 20 includes an associated display 50 that may comprise a digital electronic display, an LED indicator or indicators, or an LED display screen or the equivalent. Displays 50 are each operatively coupled to an output or outputs 210 of processor 200 that enable displays to depict the assignment status of each control selector 20 as will be explained in detail herein below.

In some aspects and embodiments each configurable control selector 20 may be assigned to a specified gas valve 4 and burner 2 combination for configurable cooktop 3 control. User interface 250 may be suitably programmed to provide a configuration display whereby an individual control selector 20 is assigned to a specific burner 2. Referring to FIG. 1 and in one exemplary embodiment of the invention, user interface 250 may be used to select one control selector 20 and assign it to a burner 2. For example, if a user wishes to assign the left-most control selector 20 to the left rear cooktop 1 burner 2, they choose a "configure" mode icon on user interface 250, select the left control selector 20 icon, on user interface 250 and then select the icon corresponding to the left rear burner 2 to complete the assignment. In this example, the left-most control selector now controls the left rear burner 2. Controller 200 then provides an output to gas valve 4 supplying left rear burner 2 only when the left-most control selector 20 is operated by turning knob 30. Similarly, each burner 2 may be assigned an individual control selector 20 by repeating the aforementioned steps. In another aspect and embodiment user interface 250 may be provided with suitable programming to display a "setting" screen to configure control selector 20. A user would then be able to select an icon on user interface 250 of a specific control selector 20 and assign that icon to a specific burner 2 icon, thereby completing the configuration. In some aspects user interface 250 may require a user to configure or assign each burner 2 to a control selector 20. Controller 200 and user interface 250 are also provided with suitable programming that prohibits selecting more than one control selector 20 to control a burner 2. Additionally, in some embodiments all burners 2 must be in an "off" position prior to making a control selector 20 assignment or prior to operating the configuration screen of user interface 250.

In accordance with further embodiments a single control selector 20 may be configured to control a plurality of burners 2 using interface 250. In these embodiments a user accesses user interface 250 to select a configure mode icon, then selects a specific control selector 20, and then selects a plurality of burner 2 icons that will be controlled by the single control selector. For example, the center-most control selector 20 in the left group of control selectors 20 can be assigned to simultaneously operate the three center burners 2 of cooktop 3, since those three burners 2 function as a griddle when being used together. Alternatively, a group of burners 2 on a single side of cooktop 3 may be assigned to a specified control selector 20 where a particular cooking application requires it.

As can readily be seen from the above description, the system disclosed herein can be used to assign any control selector 20 to any individual or group of control valve 4 and burner 2 combinations, thereby providing enhanced flexibility when operating appliance 1. Additionally, on/off buttons 40 may remain active for each control selector at all times, thereby providing a quick and efficient system 10 for turning off burners 2 assigned to that selector 2.

Referring now to FIGS. 3 and 4 and in accordance with some embodiments each control selector 20 may be provided with a display (or status indicator) 50 located in a position proximate selector 20. Displays 50 are each operatively coupled to an output or outputs 210 of processor 200 that enable displays 50 to depict the assignment status of each control selector 20. FIG. 3 depicts a display 50 that is implemented as an LED screen that shows which burner 2 is being controlled with each individual control selector 20. In some embodiments a plurality of burner icons 52 are provided on each display 50 in a pattern representative of the burner 2 arrangement on cooktop 3. The burner or burners 2 assigned to a specified control selector 20 may be represented by an illuminated icon 52 or display representing that burner 2 on the cooktop 3 so that a user may quickly glance at a control selector 20 and determine which burner or burners 2 are being controlled. Displays 50 are controlled by outputs 210 supplied by controller 200 responsive to the configuration selections programmed through user interface 250.

In accordance with some embodiments FIG. 4 depicts a display (or status indicator) 50 comprising individual LED or equivalent lights 54 that show which burner 2 is being controlled with each specific control selector 20. In some embodiments a plurality of burner LED's 54 are provided on each display 50 in a pattern representative of the burner 2 arrangement on cooktop 3. The burner or burners 2 assigned to a control 20 selector may be represented by an illuminated LED 54 or display representing that burner 2 on the cooktop 3 so that a user may quickly glance at the control selector 20 and determine which burner or burners 2 are being controlled. Displays 50 and individual LED's 54 are controlled by outputs 210 supplied by controller 200 responsive to the configuration selections programmed through user interface 250.

In a yet further embodiment of the invention user interface 250 may provide a graphical display indication of which control selector 20 controls which burner 2 by displaying the assignments in graphical form. Operator interface 250 may be provided with suitable programming instructions to depict or represent a control selector 20 for each burner 2 and/or burner group. In some embodiments this display may be a graphical representation of the burner 2 layout on cooktop 3 along with an indication of the assigned control selector 20 for each burner 2. It should be understood that a wide variety of different graphical displays representative of control selector 20 and burner 2 assignments are possible without departing from the scope of the invention.

In some aspects and embodiments system 10 provides an apparatus to configure a single control selector 20 to actuate and operate a customized burner 2 group that comprises any desired grouping of burners 2 for a specific cooking application. This feature of the invention may be particularly suited to commercial applications where a large volume of one food item is being prepared on an entire cooktop 3. Alternatively, cooktop 3 may be configured to assign a single control selector 20 to control each individual burner 2. In some further embodiments a burner 2 or burner 2 group may not be assigned any control selector 20, thereby effectively turning off all non-assigned burner 2 and valve 4 combinations. This feature of the invention is particularly advantageous where it is desirable to disable all or some of cooktop 3 operation for safety considerations.

In a yet further operational mode, for example a multi-burner mode, a single control selector 20 may be assigned through operator interface 250 to operate a pair of individual front and rear burners 2 of a burner group independently but simultaneously, thereby providing even heat across two burners 2.

Figure 6:
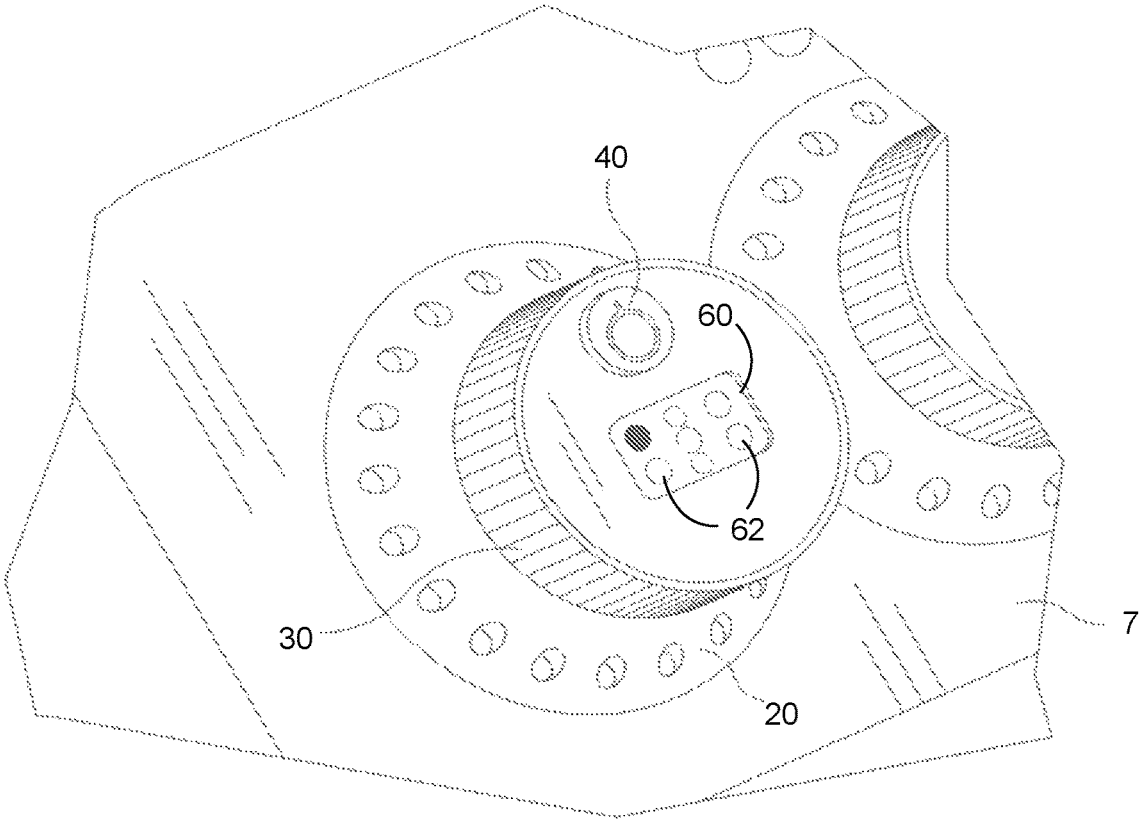
FIG. 6 is a detail view of a control selector with an integrated illuminated display in accordance with various embodiments.
Figure 7:
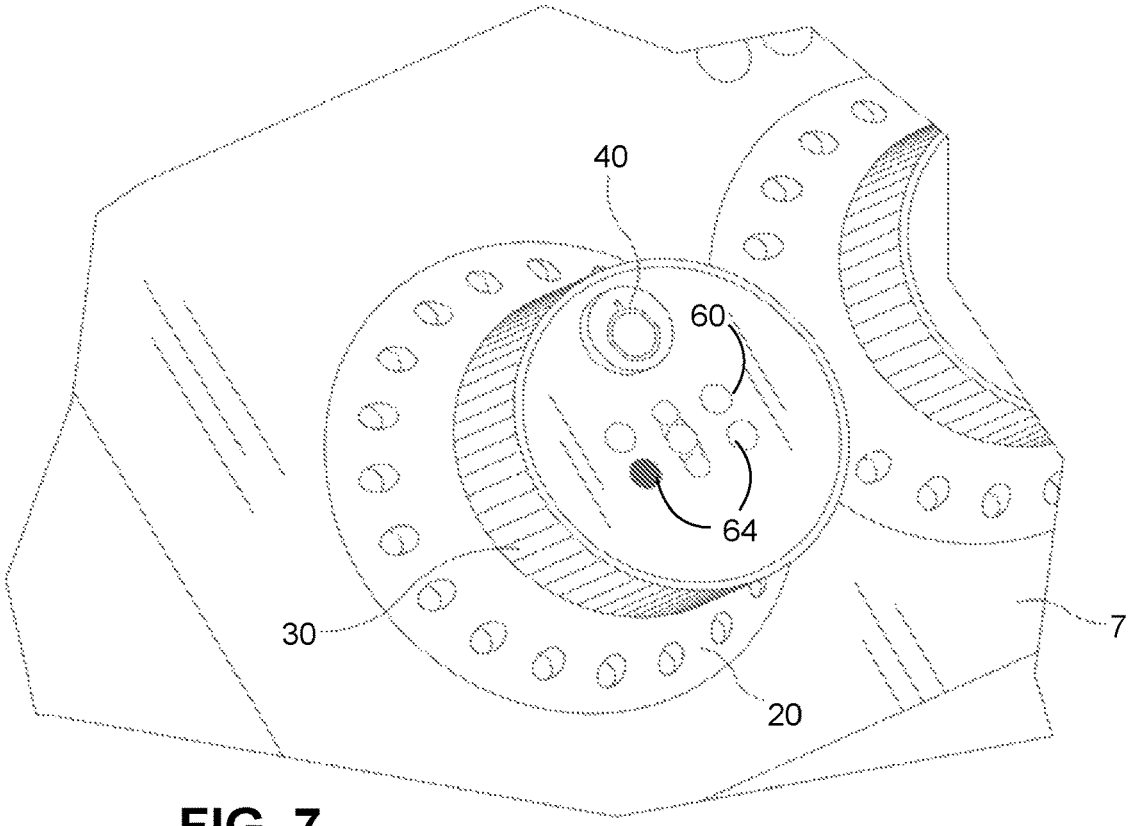
FIG. 7 is a detail view of another control selector with an integrated illuminated display in accordance with various embodiments.

Now turning to FIGS. 6 and 7 and in accordance with some embodiments each control selector 20 may be provided with an illuminated status indicator or display 60 disposed on a face thereof. Illuminated status indicators or displays 60 are each operatively coupled to an output or outputs 210 of processor 200 that enable status indicators or displays 60 to depict the assignment status of each control selector 20 on a face of the control selector itself. FIG. 6 depicts a display screen implementation of an illuminated status indicator utilizing an LED, LCD or other suitable pixel-based, icon-based, or other graphical display that depicts which burner 2 is being controlled by each individual control selector 20. In some embodiments, for example, a plurality of burner icons 62 may be provided on each illuminated status indicator or display 60 in a pattern representative of the burner 2 arrangement on cooktop 3. The burner or burners 2 assigned to a specified control selector 20 may be represented by a differently-illuminated icon 62 or other graphical indication representing that burner 2 on the cooktop 3 so that a user may quickly glance at a control selector 20 and determine which burner or burners 2 are being controlled by that control selector (e.g., for control selector 20 of FIG. 6, a left rear burner assignment is illustrated). Displays 60 may be controlled by outputs 210 supplied by controller 200 responsive to the configuration selections programmed through user interface 250.

It will be appreciated that various icons and/or alphanumeric indicators may be used to indicate a burner and control selector assignment on a display 60 in various embodiments, e.g., through the use of textual indicators (e.g., "RF" for right front burner, "LR" for left rear burner, etc.), or through the use of various two or three-dimensional representations of a cooktop, etc. Displays 60 may also be used to convey other information to a user, e.g., temperature or output level, burner status, etc., whether concurrently with assignment information or at different times.

In accordance with some embodiments FIG. 7 depicts an individual light implementation of an illuminated status indicator or display 60 comprising individual LED or equivalent lights 64 that show which burner 2 is being controlled by each specific control selector 20. In some embodiments a plurality of burner lights or LED's 64 are provided on each illuminated status indicator or display 60 in a pattern representative of the burner 2 arrangement on cooktop 3. The burner or burners 2 assigned to a control 20 selector may be represented by an illuminated light 64 representing that burner 2 on the cooktop 3 so that a user may quickly glance at the control selector 20 and determine which burner or burners 2 are being controlled by that control selector (e.g., for control selector 20 of FIG. 7, a left front burner assignment is illustrated). Lights 64 may be controlled by outputs 210 supplied by controller 200 responsive to the configuration selections programmed through user interface 250.

It will also be appreciated that a display 60 may be disposed on various moving or stationary faces of a control selector 20 in different embodiments. In some embodiments, for example, a control selector 20 may incorporate a rotatable knob 30 having a front face that rotates with the knob, and in some embodiments a display 60 may be provided on the rotatable front face and may rotate therewith. In other embodiments, e.g., where control selector 20 incorporates a rotatable ring, the front face of the control selector may be stationary and a display 60 disposed thereon may therefore remain in a stationary position when the rotatable ring is rotated.

While a variety of inventive embodiments have been described and illustrated herein, those of ordinary skill in the art will understand that a variety of other methods, systems, and/or structures for performing the function and/or obtaining the results, and/or one or more of the advantages described herein are possible, and further understand that each of such variations and/or modifications is within the scope of the inventive embodiments described herein. Those skilled in the art will understand that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding,"

"composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope.

What is claimed is:

1. A cooking appliance, comprising:

a plurality of gas cooktop burners having associated digital gas valves that selectively couple the plurality of gas cooktop burners to a gas supply;

a plurality of control selectors configured to control output levels of the plurality of gas cooktop burners, each control selector including an associated illuminated display disposed on a face thereof, wherein each of the plurality of control selectors is rotatable and wherein each control selector is assigned to one of the plurality of gas cooktop burners such that each gas cooktop burner from among the plurality of gas cooktop burners has one control selector from the plurality of control selectors assigned thereto; and a controller configured to control the plurality of digital gas valves in response to user input directed to the plurality of control selectors, wherein the controller is further configured to control the associated illuminated displays of the plurality of control selectors to display, for each control selector among the plurality of control selectors, to which gas cooktop burner among the plurality of gas cooktop burners such control selector is assigned, and wherein the controller is further configured to, in response to user input directed to a first control selector among the plurality of control selectors, control the digital gas valve among the plurality of digital gas valves that is associated with the gas cooktop burner among the plurality of gas cooktop burners to which the first control selector is assigned;

wherein each control selector further comprises a physical button disposed on a front face of such control selector to shut off the associated digital gas valve of the gas cooktop burner controlled by such control selector and to which such control selector is assigned.

2. The cooking appliance of claim 1, wherein the illuminated display of each of the plurality of control selectors comprises a plurality of lights arranged in a pattern representative of an arrangement of the gas cooktop burners on a cooktop, and wherein the controller is configured to control the associated illuminated displays of the plurality of control selectors by illuminating, for each control selector among the plurality of control selectors, a light among the plurality of lights in the associated illuminated display that corresponds to the gas cooktop burner among the plurality of gas cooktop burners that is controlled by such control selector and to which such control selector is assigned.

3. The cooking appliance of claim 1, wherein the illuminated display of each of the plurality of control selectors comprises a display screen, and wherein the controller is configured to control the associated illuminated displays of the plurality of control selectors by displaying, for each control selector among the plurality of control selectors, a graphical indication that corresponds to the gas cooktop burner among the plurality of gas cooktop burners that is controlled by such control selector and to which such control selector is assigned on the display screen of such control selector.

4. The cooking appliance of claim 3, wherein each graphical indication includes a plurality of burner icons arranged in a pattern representative of an arrangement of the gas cooktop burners on a cooktop.

5. The cooking appliance of claim 1, wherein each control selector comprises a rotatable knob.

6. The cooking appliance of claim 5, wherein the associated illuminated display of each control selector is disposed on a front face of the rotatable knob and rotates with the rotatable knob.

7. The cooking appliance of claim 1, wherein each control selector comprises a rotatable ring.

8. The cooking appliance of claim 7, wherein the associated illuminated display of each control selector is disposed on a stationary front face of the control selector.

9. The cooking appliance of claim 1, wherein the controller is configured to controllably reassign one or more of the plurality of control selectors to different gas cooktop burners among the plurality of gas cooktop burners and to update the associated illuminated displays of the plurality of control selectors to display, for each control selector among the plurality of control selectors, to which gas cooktop burner among the plurality of gas cooktop burners such control selector is assigned after controllably reassigning the one or more of the plurality of control selectors.

10. A control selector system for an appliance having a plurality of gas cooktop burners operated by a plurality of digital gas valves, comprising:

a plurality of control selectors configured to control output levels of the plurality of gas cooktop burners, wherein each control selector among the plurality of control selectors includes an associated illuminated display disposed on a face thereof, wherein each of the plurality of control selectors is rotatable and wherein each control selector is assigned to one of the plurality of gas cooktop burners such that each gas cooktop burner from among the plurality of gas cooktop burners has one control selector from the plurality of control selectors assigned thereto; and a controller configured to control the plurality of digital gas valves in response to user input directed to the plurality of control selectors, wherein the controller is further configured to control the associated illuminated displays of the plurality of control selectors to display, for each control selector among the plurality of control selectors, to which gas cooktop burner among the plurality of gas cooktop burners such control selector is assigned, and wherein the controller is further configured to, in response to user input directed to a first control selector among the plurality of control selectors, control the digital gas valve among the plurality of digital gas valves that is associated with the gas cooktop burner among the plurality of gas cooktop burners to which the first control selector is assigned;

wherein each control selector further comprises a physical button disposed on a front face of such control selector to shut off the associated digital gas valve of the gas cooktop burner controlled by such control selector and to which such control selector is assigned.

11. The control selector system of claim 10, wherein the illuminated display of each control selector comprises a plurality of lights arranged in a pattern representative of an arrangement of the gas cooktop burners on a cooktop, and wherein the controller is configured to control the associated illuminated display of each control selector by illuminating a light among the plurality of lights in the associated illuminated display that corresponds to the gas cooktop burner among the plurality of gas cooktop burners that is controlled by such control selector and to which such control selector is assigned.

12. The control selector system of claim 10, wherein the plurality of control selectors includes a first control selector, wherein the illuminated display of each control selector comprises a display screen, and wherein the controller is configured to control the associated illuminated display of each control selector by displaying a graphical indication that corresponds to the gas cooktop burner among the plurality of gas cooktop burners that is controlled by such control selector and to which such control selector is assigned on the display screen of such control selector.

13. The control selector system of claim 12, wherein the graphical indication includes a plurality of burner icons arranged in a pattern representative of an arrangement of the gas cooktop burners on a cooktop.

14. The control selector system of claim 10, wherein each control selector comprises a rotatable knob.

15. The control selector system of claim 14, wherein the associated illuminated display of each control selector is disposed on a front face of the rotatable knob and rotates with the rotatable knob.

16. The control selector system of claim 10, wherein each control selector comprises a rotatable ring.

17. The control selector system of claim 16, wherein the associated illuminated display of each control selector is disposed on a stationary front face of such control selector.

18. The control selector system of claim 10, wherein the controller is configured to controllably reassign a first control selector among the plurality of control selectors to a different gas cooktop burner among the plurality of gas cooktop burners and to update the associated illuminated display of the first control selector to display to which gas cooktop burner among the plurality of gas cooktop burners the first control selector is assigned after controllably reassigning the first control selector.

* * * * *